US007083066B2

(12) United States Patent
Neveu

(10) Patent No.: US 7,083,066 B2
(45) Date of Patent: Aug. 1, 2006

(54) SHEET DISPENSER WITH BRAKING MEANS

(75) Inventor: Jean-Louis Neveu, Colmar (FR)

(73) Assignee: Georgia-Pacific France, Kunheim (FR)

( * ) Notice: Subject to any disclaimer, the term of this patent is extended or adjusted under 35 U.S.C. 154(b) by 194 days.

(21) Appl. No.: 10/752,670

(22) Filed: Jan. 8, 2004

(65) Prior Publication Data

US 2004/0159670 A1 Aug. 19, 2004

(51) Int. Cl.
*A47K 10/24* (2006.01)

(52) U.S. Cl. ..... 221/53; 221/54; 221/45

(58) Field of Classification Search ..... 221/52, 221/53, 45, 47, 48, 63, 56, 54, 251
See application file for complete search history.

(56) References Cited

U.S. PATENT DOCUMENTS 2,703,664 A * 3/1955 Rabkin et al. ..... 221/248
2,991,910 A * 7/1961 Coe ..... 221/305
3,265,243 A * 8/1966 Velter ..... 221/63
5,065,895 A * 11/1991 De Luca et al. ..... 221/54
5,219,092 A * 6/1993 Morand ..... 221/53
6,241,118 B1 * 6/2001 Tramontina ..... 221/45
6,889,868 B1 * 5/2005 Magid ..... 221/45

* cited by examiner

*Primary Examiner*—Eileen D. Lillis
*Assistant Examiner*—Kaitlin Joerger
(74) *Attorney, Agent, or Firm*—Breiner & Breiner, L.L.C.

(57) ABSTRACT

The invention relates to a dispenser of sheets stacked inside a compartment, such as a vertical one, with a dispensing slot and provided with means for slowing the advance of the stack of sheets. This dispenser is characterized in that such means are represented by flexible elements mounted so as to project into the compartment, elements on which the sheets rest. In one embodiment the flexible elements are made up of fibers and form brushes. The elements may also be in the form of flexible blades or that of the coils of a spring.

9 Claims, 2 Drawing Sheets

SHEET DISPENSER WITH BRAKING MEANS

FIELD OF INVENTION

The invention relates to dispensers of products in the form of sheets, such as paper. It relates, in particular, to the area of articles made of tissue paper for sanitary or household use.

BACKGROUND OF INVENTION

When necessary, the managers of premises open to the public, such as hotels, restaurants, workshops, or others, make articles for wiping available to users. What are involved, as needed, are hand towels, napkins, dust cloths, or other equivalent articles. The products may be made available in dispensing devices, in the form of folded sheets rectangular in shape stacked one on the other or interleaved to form packs containing several dozen units. The dispensers claimed for this invention are boxes more or less parallelepiped in shape which are generally secured to a vertical wall, with a dispensing opening in the lower area of the surface. The invention also relates to dispensers where the sheets that they contain are forced by spring means against the surface, which includes the dispenser opening.

In some cases, for example, in places where there is heavy user traffic, it is desirable to have dispensers of large capacity, which need not be restocked too often.

The problem encountered when a large number of sheets are stacked is that of weight. Even if each sheet of cellulose wadding is light, the stack formed in dispensers of large capacity may weigh 2 to 3 kilograms. When the device is full, a user experiences a certain amount of difficulty in extracting sheets. The resistance encountered may be enough to tear the paper.

It is not possible to use high-capacity dispensers in certain applications involving very soft products of very low mechanical strength.

This phenomenon is accentuated when a user tries to extract a sheet with wet hands, as is the case with hand towels, or when the user applies an extraction force to a limited area, as is the case with table napkins, which are extracted with the ends of the fingers.

In order to remedy this problem the proposal has already been made to provide rigid knobs inside the compartment containing the products, in the lower part of the compartment. These rigid knobs form a narrow passage effectively ensuring a certain amount of restraint. They are not entirely satisfactory, however, to the extent that they block the entire pack when the weight of the latter is not great enough to cause it to clear the obstacle. These braking means are efficient when the compartment is full and the stack is heavy, but become troublesome when the compartment is almost empty, since they then impede access to the products, which tend to remain wedged inside the dispenser.

A proposal has also been made for metal plates inclined at an angle to the vertical, plates, which form a narrowed passage slowing descent of the sheets. The problem is the same, since ultimately an entire pack is held back.

OBJECTS AND SUMMARY OF INVENTION

The object of the invention is represented by means ensuring braking of sheets inside a sheet dispenser, which means do not exhibit the disadvantages of earlier solutions.

In accordance with the invention the dispenser of sheets stacked inside a compartment, such as a vertical compartment, with a sheet-dispensing opening is provided with means for slowing the progress of the sheets. It is claimed for the invention that the sheet slowing means are made up of projecting flexible elements mounted inside the compartment, sheets resting on these elements.

In one embodiment of the invention, the dispensing opening is situated in the lower part of the compartment.

This solution makes it possible to produce the slowing means in a very simple manner without the risk of blocking the packaged sheets; it is easy to select an element flexible enough to give way when subjected to a very weak force. Satisfactory slowing is ensured by multiplying the number of elements along the wall of the compartment in order to apply the necessary friction.

In a first embodiment the elements are made up of fibers. It is advantageous for these fibers to form brushes, that is, more or less dense groups or clusters mounted continuously or spaced a certain distance from each other along the compartment. The brushes are positioned preferably on two opposite sides of the compartment. The length of the fibers may vary from one end of the compartment to the other.

In another embodiment the elements are made up of flexible blades. The blades may be mounted in a row on each side of the compartment. Their spacing may remain constant or may vary.

In another embodiment the elements are made up of coils of at least one elastic spring suspended over at least a part of the length traversed by the sheets in the stack. By preference two are mounted, one opposite the other on two opposite sides of the compartment. The spring selected is fine enough not to block a pack of sheets in its coils.

BRIEF DESCRIPTION OF THE DRAWINGS

Other advantages and additional characteristics are presented in the following description of different non-restrictive embodiments of the invention, with reference to the attached drawings, of which

DETAILED DESCRIPTION OF THE INVENTION

Figure 1:
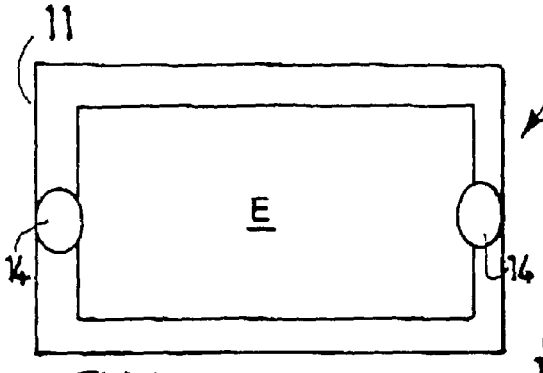
FIG. 1 presents a diagram of a top view with means claimed for the invention, FIG. 2 the dispenser in cross-section, FIG. 3 mounting of rods on a support rod, FIG. 4 another embodiment of braking means made up of fibers, FIG. 5 another braking means made up of fibers, FIG. 6 another braking means made up of fibers, FIG. 7 braking means made up of a spring.
Figure 2:
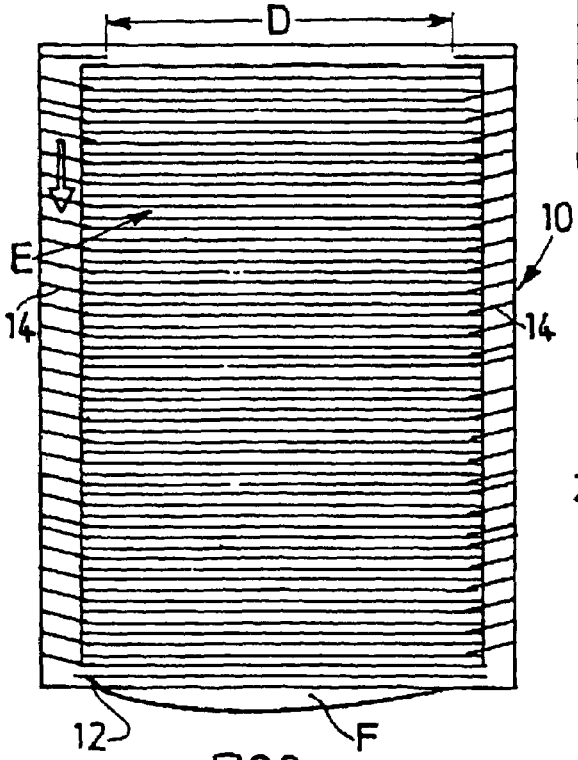
Figures 3, 4, 5:
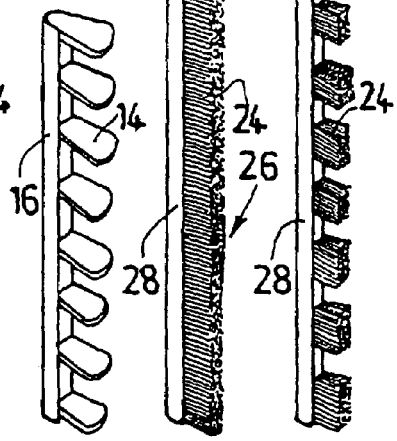

A dispenser comprising a compartment 10 is shown in diagram form in FIG. 1. It is rectangular in section; it contains a stack E of sheets or formats F which are removed one by one through the dispensing slot 12 situated in the lower part of the dispenser as shown in FIG. 2. They may be represented, for example, by paper towels simply stacked one on the other or interleaved as in the state of the art. In this embodiment flexible blades 14, made of an elastomer, for example, are mounted on one part of the length traversed by the sheets in the stack. The blades project into the interior of the compartment. They are secured by embedding in grooves on one edge of the vertical wall 11. The opposite edge is clear. As is shown in FIG. 3, the blades 14 are secured to advantage on a rod 16 forming intermediate support. The support is then fastened to the interior wall of the dispenser.

The blades 14 are parallel to each other. The distance D separating the blades on one side from those on the other is such that the blades ensure rubbing of the clear edge against the stack of sheets. As is to be seen in FIG. 2, the blades may penetrate the stack at least to some extent and may thus be inserted between two sheets F. The rubbing is sufficient to apply a retaining force against the weight of the whole. The blades are deformed enough not to impair the sheets F.

It will be noted that, as a result of these simple means, the braking force is in a way proportional to the height of the stack which comes in contact with the blades. As the height diminishes the braking force is reduced and does not prevent advance of the stack.

In another embodiment fibers 24 are used rather than blades.

It is advantageous for these fibers to be mounted in brushes 26 as shown in FIG. 4. The fibers are held in a groove 28. A fairly wide range of options is available for selection of the length and thickness of the fibers and the fiber density. Selection is made by way of experiment so as to provide the braking desired as a function especially of the height of the stack and the size of the sheets F.

It is not necessary to mount brushes continuously along the compartment. Brush elements may be mounted separately from each other as illustrated in FIG. 5.

Figures 6, 7:
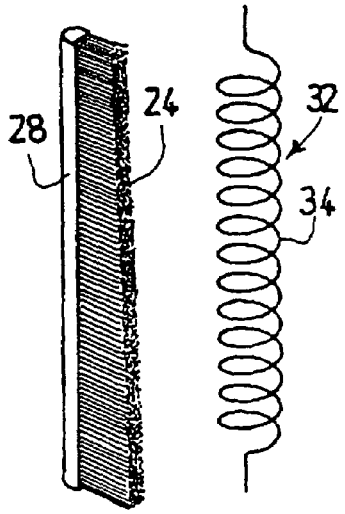

It is also possible to vary the length of the fibers along the groove 28 as shown in FIG. 6, which shows that the length of the fibers increases from the top downward. These characteristics may, of course, be combined.

Use may be made for the fibers of materials which impart the consistency of horsehair to them. For example, polypropylene fibers having a diameter ranging from 10/100 to 30/100 mm, and especially 15/100 mm, are suitable. Other materials such as natural fibers, but preferably synthetic ones such as those of polyamides, are possible. The length of the fibers making up the brush advantageously range from 10 to 55 mm, preferably from 15 mm to 25 mm. The brush width may range from 3 to 10 mm, preferably from 3.5 to 5 mm.

In another embodiment use is made as braking means of a spring 32, which may be of a plastic material or preferably of metal, one of the helical type as shown in FIG. 7. This spring is produced by rolling thin metal wire in a spiral along one axis. In this instance the turns 34 are all of the same diameter. The spring is mounted by drawing it out and securing it when extended by its two ends along the internal wall of the dispenser. For example, use may be made of a spring 5 cm long at rest and stretch it over 20 cm when securing it. This applicative solution is particularly simple. Two springs are positioned on the opposite walls at a distance from each other such that the sheets are held between the turns by their edges. For example, the distance between the axes of the two springs 32 corresponds to the size of the stack of sheets in a direction parallel to the dispensing slot 12.

Many embodiments are possible without going beyond the scope of the invention. In the case of fibers, for example, the latter may be secured by one end between two metal wires which are twisted like a medical swab.

The invention also applies to dispensers equipped with means such as springs designed to hold the sheets against the surface in which the dispensing slot 12 is situated.

Consequently, consideration may be given without going beyond the scope of the invention to a dispenser such that the direction of sheet movement is horizontal or more or less horizontal, as is also the axis of the force of application of sheets to the dispensing slot. The flexible elements claimed for the invention are then mounted parallel to this axis.

Tests have been conducted to demonstrate the effectiveness of the solution claimed for the invention.

Two braking elements as illustrated in FIG. 5 were mounted in a vertical-compartment dispenser.

The fibers or bristles were of polypropylene, their length 15 mm. For sheets 167 mm wide brushes were mounted on each side of the compartment, spaced at a distance D of 160 mm. Braking was applied in this case over 7 mm, in effect by bending of the fibers making up the brush.

A dispenser was suspended on a beam by way of scales or force meter. Sheets were removed through the lower surface of the dispenser. Measurement was thus made both of the weight of the dispenser and of the force necessary for removal of sheets individually.

Figure 8:
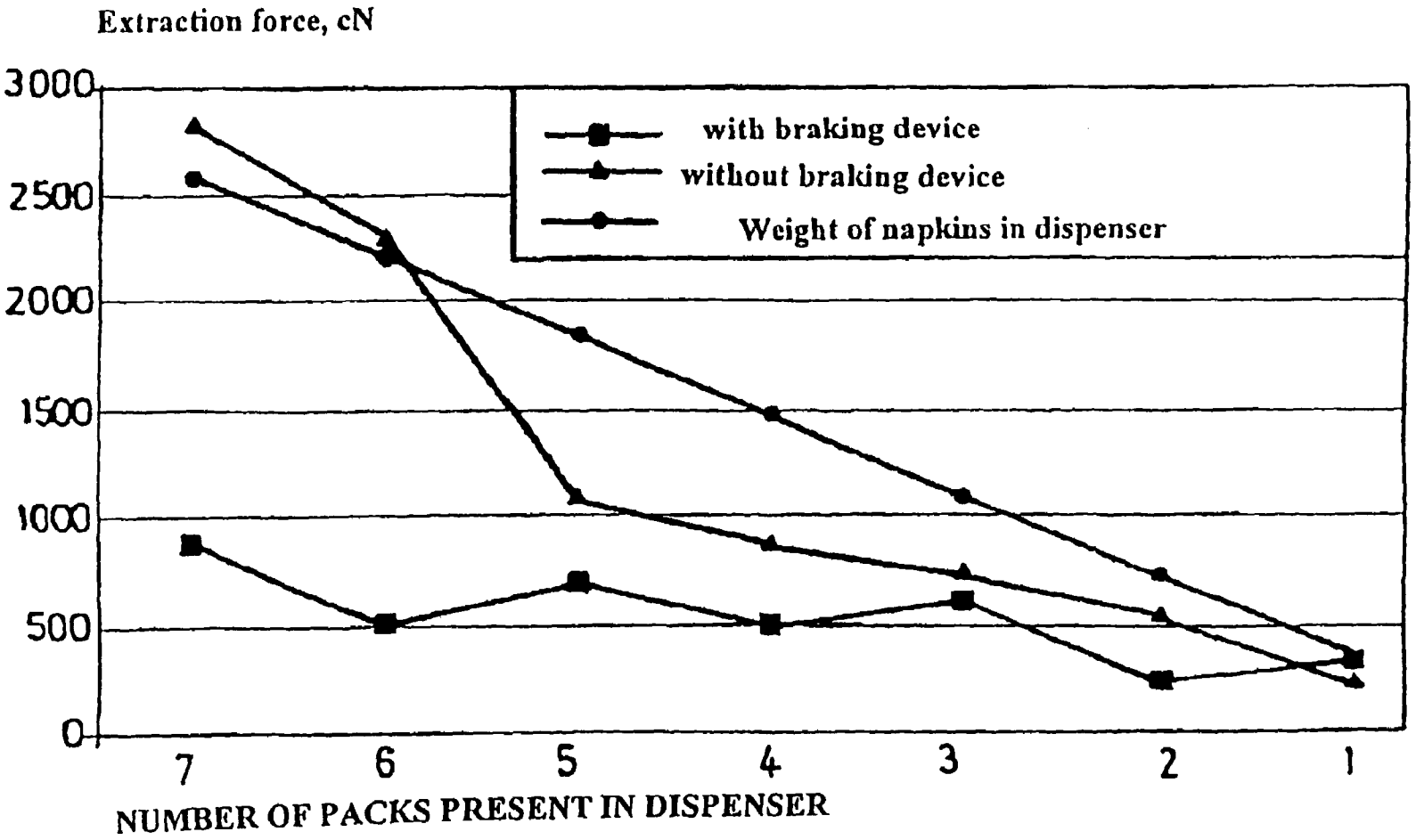
FIG. 8 is a graph illustrating the effect of the braking means claimed for the invention on the resistance of the sheets to extraction plotted against the weight of the stack of sheets.

The dispenser used contained 7 packs of 250 sheets. The weight of the sheets is plotted in FIG. 8 against the number of packs present in the dispenser and the force cN required for removal of the sheets. In one case the dispenser had braking means as claimed for the invention, and in the other such means were absent.

It was found that, when braking means were installed in the dispenser, the force required for removal of the sheets remained below 1000 cN, even for a total weight of 2500 cN. It was also found that, when braking means were absent, resistance to removal was very high with the dispenser full. With a resistance to removal such as this it is difficult to avoid tearing the paper, in contrast with a dispenser provided with braking means as claimed for the invention.

The invention claimed is:

1. A dispenser for stacked sheets comprising a compartment with a dispensing slot, and means for slowing advance of a stack of sheets, wherein said means includes a plurality of projecting flexible elements positioned inside the compartment such that sheets can rest thereupon, and wherein the flexible elements are fibers.

2. A dispenser as claimed in claim 1, wherein the fibers have a diameter ranging from 10/100 mm to 30/100 mm and a length ranging from 10 to 55 mm.

3. A dispenser as claimed in claim 1 or 2, wherein the fibers form brushes.

4. A dispenser as claimed in claim 3, wherein the brushes are positioned discontinuously along the compartment.

5. A dispenser as claimed in claim 1 or 2, wherein the fibers are tapered in length and the length of the fibers increases as the fibers are positioned closer to the dispensing slot.

6. A dispenser as claimed in claim 3, wherein the fibers are tapered in length and the length of the fibers increases as the fibers are positioned closer to the dispensing slot.

7. A dispenser as claimed in claim 4, wherein the fibers are tapered in length and the length of the fibers increases as the fibers are positioned closer to the dispensing slot.

8. A dispenser for stacked sheets comprising a compartment with a dispensing slot, and means for slowing advance of a stack of sheets, wherein said means includes a plurality of projecting flexible elements positioned inside the compartment such that sheets can rest thereupon, and wherein the flexible elements are flexible blades.

9. A dispenser for stacked sheets comprising a compartment with a dispensing slot, and means for slowing advance of a stack of sheets, wherein said means includes a plurality of projecting flexible elements positioned inside the compartment such that sheets can rest thereupon, and wherein the flexible elements are coils of a helical spring under tension extending over at least part of a lengthwise area which receives stacked sheets.

* * * * *

UNITED STATES PATENT AND TRADEMARK OFFICE

CERTIFICATE OF CORRECTION

PATENT NO. : 7,083,066 B2
APPLICATION NO. : 10/752670
DATED : August 1, 2006
INVENTOR(S) : Jean-Louis Neveu It is certified that error appears in the above-identified patent and that said Letters Patent is hereby corrected as shown below:

On the title page, insert the following:

-- [30] Foreign Application Priority Data
Jan. 10, 2003 [EP].....03000396 --.

Signed and Sealed this

Third Day of October, 2006

JON W. DUDAS
*Director of the United States Patent and Trademark Office*